US006302395B1

(12) United States Patent
Astaneha

(10) Patent No.: US 6,302,395 B1
(45) Date of Patent: Oct. 16, 2001

(54) COMBINATION DICE, CARD AND ROULETTE GAMBLING GAME

(76) Inventor: Morteza Astaneha, 77 Prospect Ave., Apt. 4-I, Hackensack, NJ (US) 07601

( * ) Notice: Subject to any disclaimer, the term of this patent is extended or adjusted under 35 U.S.C. 154(b) by 0 days.

(21) Appl. No.: 09/448,113

(22) Filed: Nov. 24, 1999

Related U.S. Application Data

(63) Continuation-in-part of application No. 09/314,354, filed on May 19, 1999.

(51) Int. Cl.[7] ..... A63F 3/00
(52) U.S. Cl. ..... 273/274; 273/146
(58) Field of Search ..... 273/274, 299, 273/146; 463/17, 18, 19, 20

(56) References Cited

U.S. PATENT DOCUMENTS

| | | | |
|---|---|---|---|
| D. 106,967 | | 11/1937 | Danon . |
| D. 275,116 | | 8/1984 | Mickens . |
| 2,077,124 | | 4/1937 | Miller et al. . |
| 2,253,787 | | 8/1941 | Kelly . |
| 2,370,229 | | 2/1945 | Buckley . |
| 3,889,954 | * | 6/1975 | Malisow . |
| 3,913,919 | | 10/1975 | Carpenter . |
| 3,975,022 | | 8/1976 | Figueroa . |
| 4,077,631 | | 3/1978 | Tela, Jr. . |
| 4,149,728 | | 4/1979 | Thompson . |
| 4,222,561 | * | 9/1980 | Whitten . |
| 4,247,114 | | 1/1981 | Carroll . |
| 4,346,900 | | 8/1982 | Lamlee . |
| 4,887,819 | * | 12/1989 | Walker . |
| 4,941,665 | | 7/1990 | Klamer . |
| 5,102,135 | | 4/1992 | Addiechi . |
| 5,133,559 | | 7/1992 | Page . |
| 5,540,442 | | 7/1996 | Orselli et al. . |
| 5,584,763 | | 12/1996 | Kelly et al. . |
| 5,636,838 | | 6/1997 | Caro . |
| 5,785,596 | | 7/1998 | Hobert . |
| 5,799,941 | * | 9/1998 | Panneton . |

* cited by examiner

*Primary Examiner*—William M. Pierce
(74) *Attorney, Agent, or Firm*—Richard M. Goldberg

(57) ABSTRACT

A gambling game includes a dice table having an upper throwing surface on which dice can be thrown; at least one die to be thrown on the upper throwing surface by a player, each die having a plurality of faces, each face having a number and a color thereon, with the numbers and colors of at least some of the faces being different from the numbers and colors of other ones of the faces, and with one face including an ALL LOSE designation; a rotatable wheel to be rotated by a dealer and positioned adjacent the dice table, the rotatable wheel having a plurality of segmented areas with different numbers and colors thereon, and at least one segment including an ALL LOSE designation; an indicator associated with the rotatable wheel for indicating one of the segmented areas of the rotatable wheel; a plurality of cards, each card having a number and a color thereon; and a wagering area for wagering on number and colors combinations from a combination of at least one number and color on an upper face of the at least one die, a number and color in an indicated segmented area and at least one number and color on at least one of the cards.

21 Claims, 3 Drawing Sheets

COMBINATION DICE, CARD AND ROULETTE GAMBLING GAME

REFERENCE TO RELATED APPLICATION

The present application is a continuation-in-part of U.S. patent application Ser. No. 09/314,354, filed May 19, 1999 by the same applicant herein and entitled COMBINATION DICE AND ROULETTE-TYPE GAMBLING GAME AND METHOD FOR PLAYING THE SAME.

BACKGROUND OF THE INVENTION

The present invention relates generally to a combination dice, card and/or roulette-type gambling game, and more particularly, is directed to a combination dice, card and/or roulette-type gambling game that provides more variations in play and in wagering.

In a conventional roulette game, there is a rotatable roulette wheel that has numbered pockets with numbers "1" through "36", "0" and "00" therein. The pockets with numbers "0" and "00" give the house or dealer an advantage of 5.26%. Each pocket is separated from its neighbors by metal dividers. Half of the 36 numbers are black while the other half are red. The pockets containing the numbers "0" and "00" are green. The numbers are not in consecutive order, but rather, are in random order, with red and black numbers alternating, except when broken up by "0" and "00".

There are numerous possible wagers that can be made, which are paid off at different odds. For example, for even money, that is, 1:1 pay off, there are wagers on odd numbers, even numbers, red numbers, black numbers, a range of low numbers "1" through "18" and a range of high numbers "19" through "36". For higher odds, such as 35:1, a player can wager on a single number, while wagers on two numbers pay off at 17:1; wagers on three numbers pay off at 11:1; wagers on four numbers pay off at 8:1; wagers on five numbers pay off at 6:1; wagers on six numbers pay off at 5:1; wagers on dozens, such as "1" through "12", "13" through "24" or "25" through "36" pay off at 2:1, as would wagers on one of the three columns of numbers.

However, gambling with a roulette wheel by itself can become boring or tiresome over time. In the first place, there is only one item moving at a time, namely, the ball about the wheel. Second, the players have no input into the chance outcome, since the dealer spins the wheel. Thus, the players can only wager on the above discussed combinations. Third, although there is some variation in the types of wagers that can be made, the types of wagers are still somewhat limited. As a result, the players can become easily bored after a short time, and retire from the game, which is undesirable to the casino.

The same comments apply to other roulette-type games, such as wheel of fortune games in casinos, in which the dealer spins a wheel having arcuate segments thereon, and a flexible pointer is provided to eventually stop the wheel and point to a particular segment having a monetary amount listed thereon. Such games are even less interesting, since there is no color aspect thereto.

The use of dice in a gambling game is known from the game of craps. In craps, there is a table with betting areas thereon, and two dice, each having numbers "1" through "6" thereon. With craps, the probability of rolling different number combinations varies. For example, the probability of rolling a number combination "7" is greater than rolling a number combination "4".

In craps, each of the number combinations "2", "3" and "12" is termed "craps", and is a loser. Each of the number combinations "7" and "11" is termed a "natural" and is a winner. The remaining number combinations are termed "point-numbers" and must be repeated before a number combination "7" is rolled, in order to win. Thus, the number combination "7" can be a winning combination if thrown on a first roll, and a losing combination if not thrown on a first roll. The player or shooter loses the dice to another player or shooter only when the first player throws a "seven-out", that is, the player throws a number combination "7" before repeating a first thrown number combination "4" through "6" or "8" through "10".

Various wagers can be made in craps. For example, there is an area called a "pass line". When bets are placed in this area, the players are wagering that the shooter will throw a repeat number combination before the number combination "7". Since the probability of throwing a number combination "7" is greater than other number combinations, it is best to wager on the "come-out" roll since the number combination "7" is then a winning combination. The house or dealer has a 1.41 percent advantage overall considering the come-out and point-numbers.

There are also odds bets. This depends on the different probabilities of throwing numbers. For example, the probability of throwing a number combination "7" is 5:1; of repeating a number combination "6" or "8" before throwing a number combination "7" is 6:5; of repeating a number combination "5" or "9" before throwing a number combination "7" is 3:2; of repeating a number combination "4" or "10" before throwing a number combination "7" is 2:1. Odds bets are paid off on the actual probabilities.

Other wagers are also possible. However, because of the different wagers and probabilities, the game of craps becomes relatively complicated to play. A casual observer in a casino, who knows little about casino games, would determine that craps is the most complicated and difficult to learn, game. This is because, unlike roulette, the table layout looks complicated, and there are so many different types of complicated bets, resulting in much confusion. For example, sometimes the number "7" wins and sometimes it does not.

However, unlike roulette, craps or dice tables bring out the emotions of the players more than other gambling games. This is because there is a certain camaraderie among the players, which does not occur with roulette.

Different card games are also provided in casinos. For example, blackjack is a relatively simple game, while poker becomes more complicated.

Various games have been proposed which use some of the aspects of a craps game, some of the aspects of card games, and some of the aspects of a roulette or roulette-type game, but no games which use a combination of the numbers on the different elements in an arithmetic operation, or different colors thereon, to provide a result that can be wagered on.

For example, U.S. Pat. No. 4,247,114 to Carroll discloses a board game similar to craps and which uses three dice, one a red color, one a green color and the last a white color. The players can wager on a particular number of a particular die, odd or even numbers, etc. However, there is no input by the dealer as in roulette or wheel of fortune games, and the wagering of this game can be complicated in the manner of a craps game.

U.S. Pat. No. 5,133,559 to Page discloses a casino dice game which uses six dice, including three larger size dice and three smaller size dice, each with numbers "1" through "6" thereon, and each having a single color, for example, there may be two red, two blue and two white dice. Betting can be based on different combinations of colors as shown in Table 3 in column 7 of the patent. However, this game is also relatively complicated from a wagering standpoint, and there is again no input by the dealer as in roulette or wheel of fortune games.

U.S. Pat. No. 4,346,900 to Lamlee discloses a game board with dice having opposite faces colored the same and the different faces are numbered as well from "1" through "6". This game includes three concentric rings on the game board for placing different wagers from rolls of the dice. Thus, for example, the outer ring includes areas in which the colors can be bet, while the inner rings include areas in which the numbers can be bet. However, there is again no input by the dealer as in roulette or wheel of fortune games, and the board and wagering arrangement is relatively complicated.

U.S. Pat. No. Des. 106,967 shows a combination game board and apparatus in which a roulette wheel is provided with different numbers and colors that can be bet, including even numbers, odd numbers, ranges of numbers, particular numbers and different color combinations. However, this only corresponds to a conventional roulette wheel in which there is no input by the players, except for the wagering.

U.S. Pat. No. 2,253,787 to Kelly discloses a game which uses an inner ring and an outer ring, both concentrically surrounding a stationary central area on the game board. There are numbers "1" through "6" in the stationary central area, each number corresponding to six segments on each inner and outer ring. There are also individual game boards and dice having numbers thereon. The first die has one color, for example, red, and the second die has another color. In use, the user throws the dice. The user then locates the segmented area on the inner ring corresponding to the stationary number in the central area, in response to the number on the first die. The user then locates the particular number from the six segment area of the inner ring based on the number on the second die, and reads the directions on the outer ring as to what action to take, for example, "Draw 20,000." However, this is a board game only, and the determination of an outcome is only made by the player from the roll of the dice. The inner and outer rings are set in advance, and are not rotated during the throw of the dice. Further, the colors on the dice are not used for any purpose, except to associate with the inner and outer rings.

U.S. Pat. No. 3,913,919 to Carpenter discloses a game including three dice, each having a different color, and each having six sides. The player makes a wager, and then throws the three dice. If any of the combinations in column 2 of the patent occur, the player wins. The player also previously placed three cards having symbols thereon face down, so that only the player knows what it is on the cards. After the player rolls the dice, he can bet additional money to try to bluff the other players to believe that the roll of the dice matches the three cards. However, there is no roulette wheel or wheel of fortune, and there is no input by the dealer. Also, the wagering can be relatively complicated.

U.S. Pat. No. 4,149,728 to Thompson discloses a poker game using a roulette wheel. The roulette wheel is spun, and a card corresponding to the item on the roulette wheel is selected and placed on the playing table. Thus, the roulette wheel is merely a way of selecting cards for display. Wagers can be placed on groups of cards or poker hands.

U.S. Pat. No. 4,941,665 to Klamer discloses a rotatable game including a center rotatable wheel with outer discs having different colors and a plurality of numbers thereon. However, there are no dice, and the game is relatively complicated to play.

U.S. Pat. No. 5,785,596 to Hobert discloses a craps or dice game and which further provides a super jackpot. A player must match the numbers of the super jackpot to win the super jackpot. The game, however, is a craps game only. The super jackpot can be selected by computer or mechanical arrangements, such as a roulette wheel.

OBJECTS AND SUMMARY OF THE INVENTION

Accordingly, it is an object of the present invention to provide a gambling game that overcomes the problems with the aforementioned prior art.

It is another object of the present invention to provide a gambling game that includes a combination of a rotatable wheel, cards and/or dice.

It is still another object of the present invention to provide a gambling game in which action is provided by both the player and the house.

It is yet another object of the present invention to provide a gambling game with an increased number and variation of ways to wager.

It is a further object of the present invention to provide a gambling game that maintains the interest and camaraderie of the players in the game.

It is a still further object of the present invention to provide a gambling game in which the players can easily understand the different wagers that can be made.

It is a yet further object of the present invention to provide a gambling game that is easy and economical to use and manufacture.

In accordance with an aspect of the present invention, a gambling game includes a dice table having an upper throwing surface on which dice can be thrown; at least one die to be thrown on the upper throwing surface by a player, each die having a plurality of faces, each face having a number thereon, with the numbers of at least some of the faces being different from the numbers of other ones of the faces; a rotatable wheel to be rotated by a dealer and positioned adjacent the dice table, the rotatable wheel having a plurality of segmented areas with different numbers thereon; an indicator associated with the rotatable wheel for indicating one of the segmented areas of the rotatable wheel; a plurality of cards, each card having a number thereon; and a wagering area for wagering on number combinations from an arithmetic operation of a combination of at least one number on an upper face of the at least one die, a number in an indicated segmented area and at least one number on at least one of the cards.

Preferably, there are two dice, wherein each die includes six faces, at least some of the faces with a respective number thereon. At least one face on one die includes an all lose area in which a player loses all wagers, regardless of number combinations that result.

In like manner, at least one segmented area on the rotatable wheel includes an all lose area in which a player loses all wagers, regardless of number combinations that result.

The wagering area includes boxed areas for wagering on a) individual numbers based on combinations from an arithmetic operation of at least one number from an upper face of the at least one die, a number in an indicated segmented area and at least one number on at least one of the cards; and b) groups of numbers based on combinations from an arithmetic operation of at least one number from an upper face of the at least one die, a number in an indicated segmented area and at least one number on at least one of the cards.

Further, each die includes a color thereon, with the colors of at least some of the faces being different from the colors of other ones of the faces; the segmented areas includes different colors thereon; and the wagering area includes boxed areas for wagering on color combinations of at least one color on an upper face of the at least one die and a color in an indicated segmented area. The cards also each include a color thereon, and the wagering area includes boxed areas for wagering on color combinations from a combination of at least one color on an upper face of the at least one die, a color in an indicated segmented area, and at least one color on at least one of the cards. Thus, the boxed areas for wagering on colors include boxed areas for wagering on a) all the same color based on color combinations from a combination of at least one color on an upper face of the at least one die, a color in an indicated segmented area, and at least one color on at least one of the cards; and b) different colors based on color combinations from a combination of at least one color on an upper face of the at least one die, a color in an indicated segmented area, and at least one color on at least one of the cards.

In accordance with another aspect of the present invention, a gambling game includes a dice table having an upper throwing surface on which dice can be thrown; at least one die to be thrown on the upper throwing surface by a player, each die having a plurality of faces, each face having a number thereon, with the numbers of at least some of the faces being different from the numbers of other ones of the faces; a plurality of cards, each card having a number thereon; and a wagering area for wagering on number combinations from an arithmetic operation of a combination of at least one number on an upper face of the at least one die and at least one number on at least one of the cards.

In accordance with still another aspect of the present invention, a gambling game includes a rotatable wheel to be rotated by a dealer and positioned adjacent the dice table, the rotatable wheel having a plurality of segmented areas with different numbers thereon; an indicator associated with the rotatable wheel for indicating one of the segmented areas of the rotatable wheel; a plurality of cards, each card having a number thereon; and a wagering area for wagering on number combinations from an arithmetic operation of a combination of a number in an indicated segmented area and at least one number on at least one of the cards.

The above and other objects, features and advantages of the invention will become readily apparent from the following detailed description thereof which is to be read in connection with the accompanying drawings.

DETAILED DESCRIPTION

Figure 1:
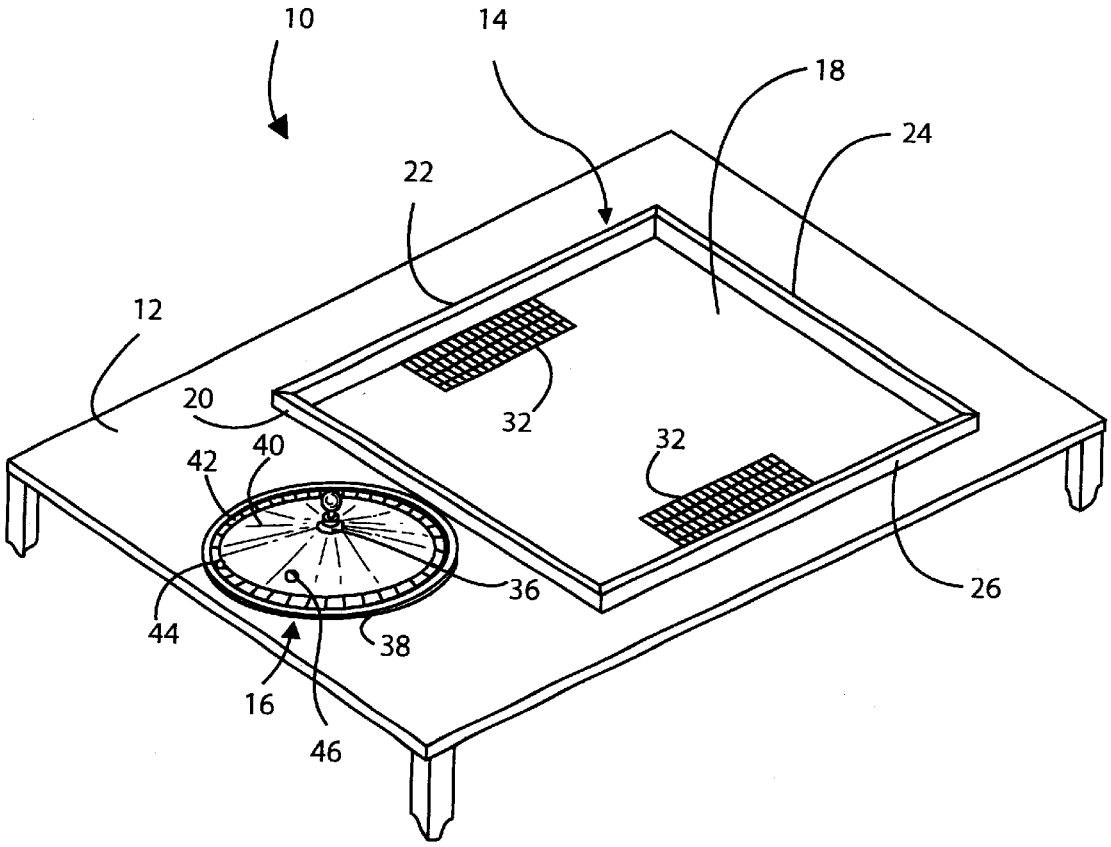
FIG. 1 is a perspective view of a gambling game according to the present invention.

Referring to the drawings in detail, and initially to FIG. 1 thereof, a gambling game 10 according to the present invention includes a table 12 or other flat surface having a dice table 14 and a roulette wheel 16 mounted thereon.

Dice table 14 includes a rectangular upper throwing surface 18 generally covered by a felt or like fabric, and four side walls 20, 22, 24 and 26 upstanding from outer edges of upper throwing surface 18. The felt will cause dice thrown therein to roll rather than slide. Thus, a player or shooter can throw a pair of dice 28 and 30 (FIG. 2) onto upper throwing surface 18. Dice 28 and 30 are prevented from escaping from upper throwing surface by side walls 20, 22, 24 and 26, and may even bounce off of these side walls. Two wagering areas 32 are printed on opposite sides of upper throwing surface 18, and will be discussed in greater detail hereinafter.

Figure 2:
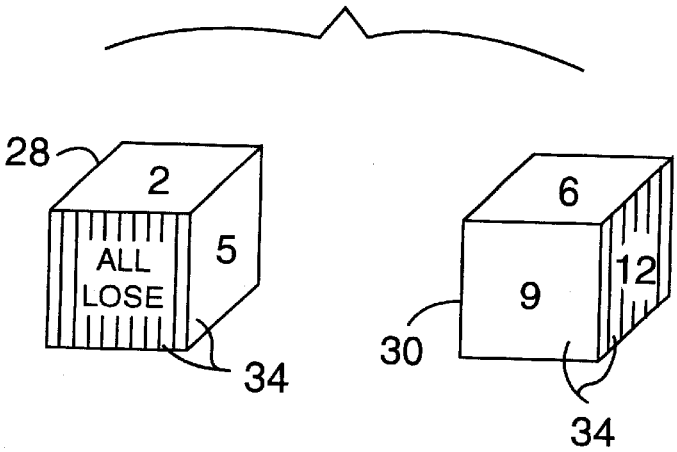
FIG. 2 is an enlarged perspective view of the dice used with the gambling game of FIG. 1.

Dice 28 and 30 are shown in detail in FIG. 2, with die 28 including six faces 34, each face having a number from "2" through "6" or an "ALL LOSE" designation, as well as one of two colors, for example, red for three faces and black for three faces, as shown by the hatching for color in FIG. 2, although more than two colors can be provided, for example, three colors or six colors. Die 30 also includes six faces 34, each face having a number from "7" through "12", as well as one of two colors, for example, red and black.

Figure 4:
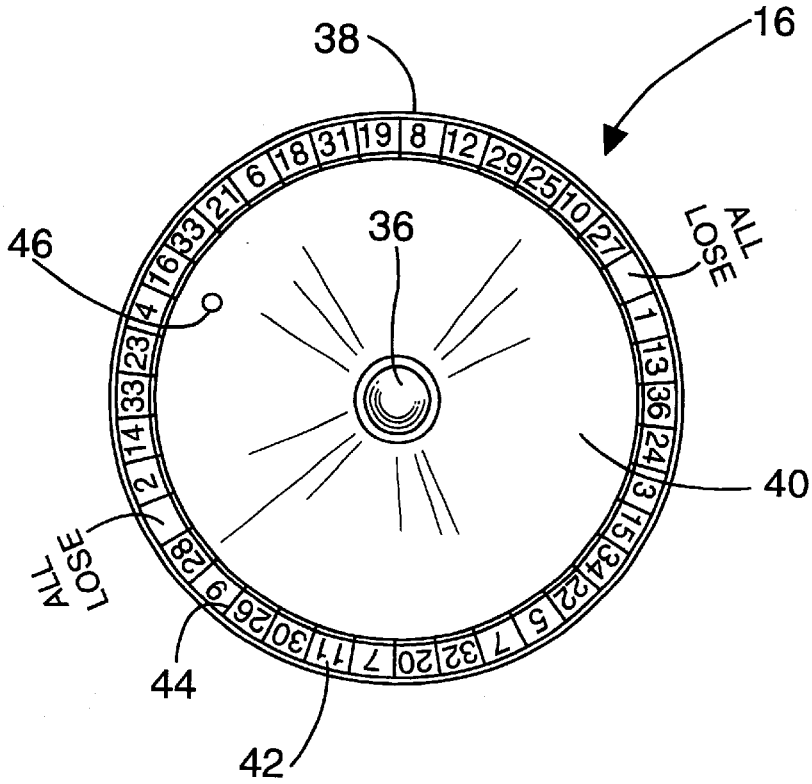
FIG. 4 is a top plan view of the roulette wheel used with the gambling game of FIG. 1.

As shown in FIGS. 1 and 4, roulette wheel 16 is rotatably mounted on an axle 36 in a case 38 which is positioned on table 12 adjacent to side wall 20 and thereby, which is adapted to be spun or rotated by the dealer. Wheel 16 can be rotated by grasping an edge thereof and spinning the same.

Wheel 16 has an upper conical surface 40 that includes thirty-eight segmented areas 42 around the periphery thereof, although the present invention is not so limited. Segmented areas 42 are separated by raised metal dividers or separators 44. Segmented areas 42 include numbers "1" through "36", respectively, as well as alternating colors of red and black, as with a conventional roulette wheel. The remaining two segmented areas include a designation "ALL LOSE". As with a conventional roulette wheel, a ball 46 is positioned on the spinning upper conical surface 40 and eventually lands in one of the segmented areas 42.

Alternatively, roulette wheel 16 can be configured similar to a wheel of fortune game, with a flexible plastic pointer that extends immediately over upper surface 40. Thus, as wheel 16 is rotated, metal dividers 44, in turn, hit against the end of the pointer. Each time that pointer end is hit, the pointer flexes to permit the respective metal divider 44 to pass by, whereupon the pointer end springs back into the next segmented area 42. Continual hitting of the pointer end by dividers 44 functions to slow down wheel 16, and eventually cause wheel 16 to stop, whereupon the pointer end remains in a particular segment 42.

Figure 3:
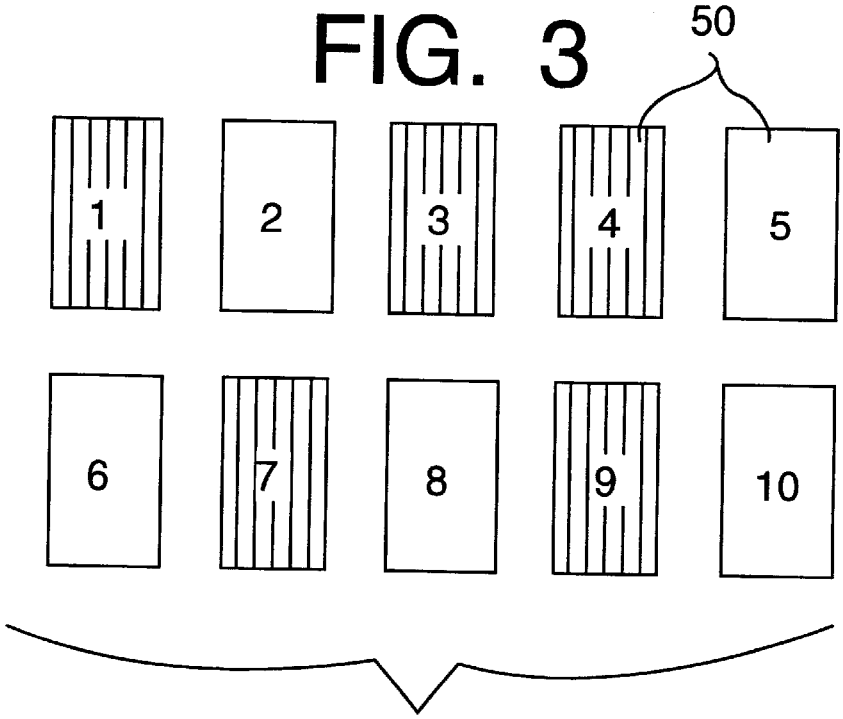
FIG. 3 is a top plan view of the cards used with the gambling game of FIG. 1.

In addition, as shown in FIG. 3, the present invention includes playing cards 50 numbered from "1" to "10". Playing cards 50 can be used only by the dealer, or can be dealt to the individual players. The cards 50 will also have a color of red or black associated therewith, as shown by the hatching.

Gambling game 10 is played by a) a combination of numbers and/or colors on the dice and the cards, b) a combination of numbers and/or colors on the cards and the roulette wheel, or c) a combination of numbers and/or colors on the dice, cards and roulette wheel. Wagering is made prior to these operations, on wagering areas 32, by reason of the combinations from roulette wheel 16, dice 28 and 30, and/or cards 50.

Figure 5:
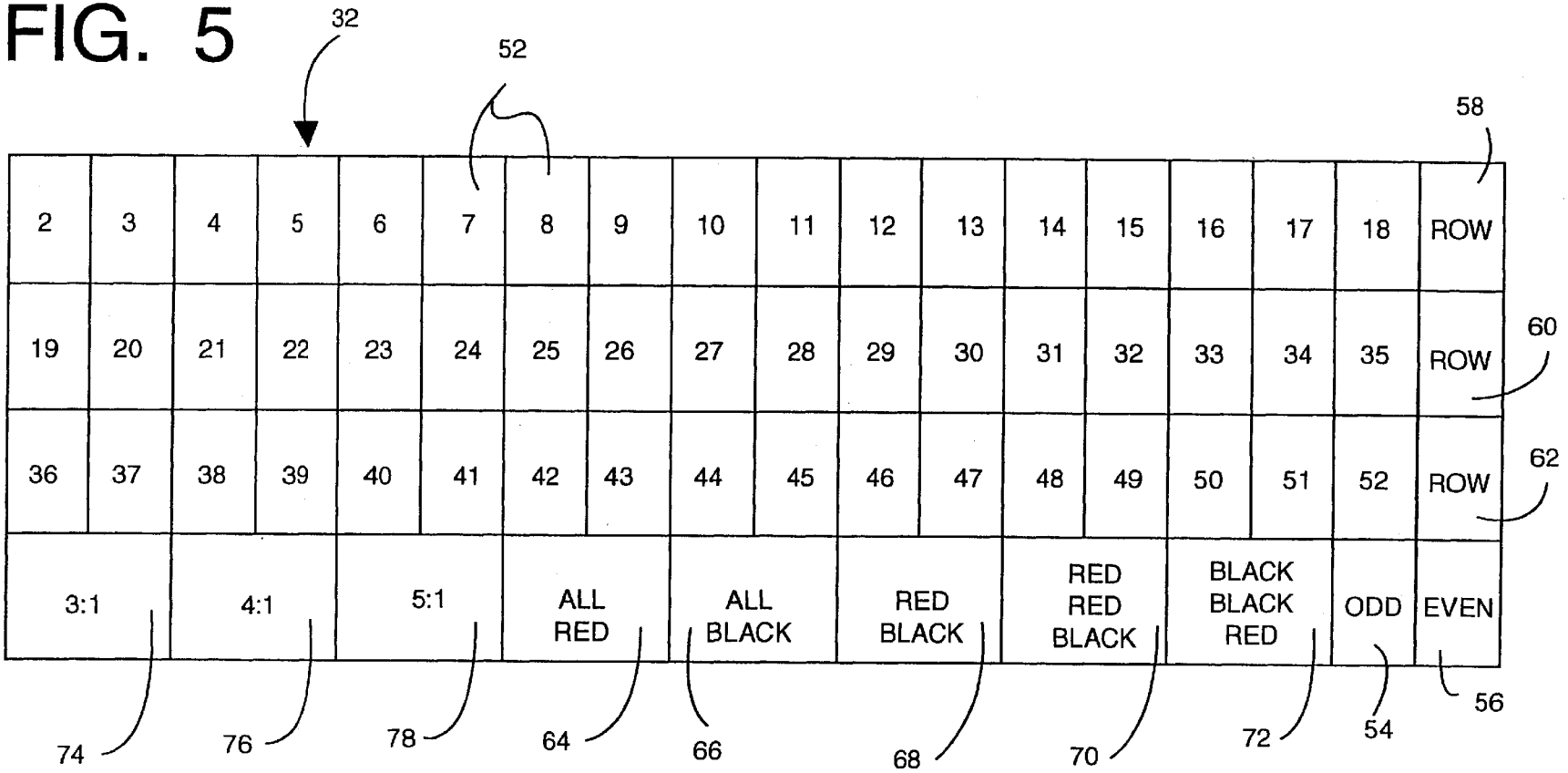
FIG. 5 is a top plan view of one of the wagering areas of the gambling game of FIG. 1.

As shown in FIG. 5, each wagering area 32 includes four rows and eighteen columns, defining number boxes 52 by which a player can place different bets, based on both colors and numbers, from a combination of wheel 16 rotated by the dealer, dice 28 and 30 thrown by the shooter or player, and/or cards 50, depending upon which game is played.

Specifically, there are fifty-one possible number combinations from "2" through "52". The number "52" is obtained from adding up the highest number "6" on die 28, "10" on cards 50 and "36" on roulette wheel 16. Thus, there are fifty-one number boxes 52, each having a single number combination from "2" through "52" therein. Based on these combinations, a player can wager on a particular number combination expected to win by adding up the numbers from the respective games. Thus, for example, the player can wager on the number combination "8" by placing a chip in the number box 52 having the number combination "8" therein. The player can also wager on two possible number combinations, for example, by placing a chip to straddle the number boxes 52 containing the numbers "8" and "25". A wager on four number combinations can also be made by placing a chip at the meeting corner of the number boxes 52 containing the four number combinations, for example, the number boxes 52 containing the number combinations "5", "6", "22" and "23".

The player can also wager on all even numbers or all odd numbers by placing a chip in the odd number box 54 or the even number box 56, which contain the designations "ODD" and "EVEN", respectively. For example, if a player bets the even number box 56, and the number combination is "8", the player wins, and if the number combination is "9", the player loses.

The player can also wager on groups of number combinations, such as low number combinations "2" through "18" by placing a chip in low number combination box 58, intermediate number combinations "19" through "35" by placing a chip in intermediate number combination box 60, or high number combinations "36" through "52" by placing a chip in high number combination box 62.

Of course, it will be appreciated that the pay-off return to the player will vary depending whether a single number combination, such as "4", or whether a group of number combinations, such as "3" and "4", or "2" through "18", is wagered. This is because the probability of selecting a single number combination is much less than the probability for selecting a group of number combinations.

In addition to the number combinations, a player can also wager on colors or color combinations. For example, the player can wager that the pointed to color on wheel 16 and the colors on die 28 will be the same color, such as all red or all black, in single color boxes 64 and 66, respectively. The player can wager that two different colors red and black will turn up, in double color box 68. In the event that three items are added together, the player can wager as to three color combinations of red, red and black in triple color box 70 or black, black and red in triple color box 72. For example, if ball 46 falls in a red segmented area 42, a card 50 has a red color and die 28 shows a black color on the upper face 34 thereof, a chip placed on the red-red-black combination in triple color box 70 will win.

The pay-off return to the player will be the same, regardless of whether a single color combination, a double color combination or a triple color combination is selected, since the probabilities for all such color combinations is the same.

Lastly, the player can increase any payout by placing a further chip in triple (3:1) box 74, two chips in quadruple (4:1) box 76 or three chips in quintuple (5:1) box 78 in which case any winnings are automatically tripled, quadrupled or quintupled.

As will be understood from the discussion hereinafter, the present invention provides a diversity in play, in that various combinations of roulette wheel 16, dice 28 and 30, and cards 50 can be used to play.

In all of the following modes of play, wagering occurs before the action is performed.

First Game

In a first game, the only elements of play are both dice 28 and 30 in combination with cards 50. In this case, a shooter or player throws dice 28 and 30 onto upper throwing surface 18 of dice table 14. Then, the dealer turns over a card 50. The numbers on the upper surfaces of dice 28 and 30 and the number on card 50 are added together to form a sum number. If a player has wagered on this sum number by placing a chip in the respective number box 52 having this sum number, that player wins.

As discussed, above, a player can also wager on two possible number combinations, for example, by placing a chip to straddle the number boxes 52 containing the numbers "3" and "4". A wager on four number combinations can also be made by placing a chip at the meeting corner of the number boxes 52 containing the four number combinations, for example, the number boxes 52 containing the number combinations "5", "6", "23" and "24".

The player can also wager on all odd numbers or all even numbers by placing a chip in the boxes 54 or 56, respectively, which contain the designations "ODD" and "EVEN", respectively. For example, if a player bets the even number box 56, and the number combination is "8", the player wins, and if the number combination is "9", the player loses.

The player can also wager on groups of number combinations, such as low number combinations "2" through "18" by placing a chip in low number combination box 58.

In addition to the number combinations, a player can also wager on colors or color combinations, such as all red in single color box 64, all black in single color box 66, red-red-black in triple color box 70 or black-black-red in triple color box 72.

If the upper face 34 of die 28 shows ALL LOSE, everyone loses, regardless of what else turns up on dice 28 or 30, or on card 50. This gives the house or casino the slight margin for winning in its favor.

Thus, in this first game, gambling game 10 includes a combination of at least two dice thrown by a player and one card turned up by the dealer, in which action is required by the player and the dealer, thereby maintaining the interest and camaraderie of the players in the game. Further, by using both a card and dice, gambling game 10 is provided with an increased number and variation of ways to wager. Also, unlike craps, with gambling game 10, the players can easily understand the different wagers that can be made.

Second Game

In a second game, the only elements of play are cards 50 and roulette wheel 16. In this case, the dealer spins roulette wheel 16, and while roulette wheel 16 is spinning, the dealer turns over a card 50. The number in the segmented area 42 into which ball 46 falls and the number on card 50 are added together.

Again, a player can wager on number and/or color combinations. If ball 46 lands in a segmented area 42 that shows ALL LOSE, everyone loses, regardless of what else turns up on card 50. This gives the house or casino the slight margin for winning in its favor.

Third Game

In a third game, the elements of play are roulette wheel 16, die 28 and cards 50. In this case, the dealer spins roulette wheel 16. At the same time, a shooter or player throws die 28 onto upper throwing surface 18 of dice table 14. Then, the dealer turns over a card 50. The number on the segmented area 42 into which ball 46 falls, the number on the upper surface of die 28 and the number on card 50 are added together to form a sum number. If a player has wagered on this sum number by placing a chip in the respective number box 52 having this sum number, that player wins.

Again, a player can wager on number and/or color combinations. If the upper face 34 of die 28 shows ALL LOSE, or if ball 46 lands in a segmented area 42 that shows ALL LOSE, everyone loses, regardless of what else turns up on die 28 or on card 50. This gives the house or casino the slight margin for winning in its favor.

It will be appreciated that any other combinations of the aforementioned elements can be used, such as two dice 28 and 30 and roulette wheel 16, two cards 50 and roulette wheel 16, two cards 50 and one die 28 or 30, etc.

Thus, gambling game 10 includes a combination of different gambling elements, in which action is required by the player and the dealer, thereby maintaining the interest and camaraderie of the players in the game. Further, by using both a card, roulette wheel and dice, gambling game 10 is provided with an increased number and variation of ways to wager. Also, unlike craps, with gambling game 10, the players can easily understand the different wagers that can be made.

It will be appreciated that various modifications can be made to the present invention, within the scope of the claims. Thus, wagering areas 32 can be modified to provide a greater or lesser number of types of wagers that can be made. For example, each wagering area 32 can be further divided into more rows to increase the types of wagers. Also, although only two colors have been shown, three or more colors can be provided to increase the types of wagers. Further, although six sided dice 28 and 30 have been shown, a greater number of sides on dice 28 and 30 can be provided, to increase the numbers and/or colors thereon. Wheel 16 can also be divided into more or less than thirty-eight segmented areas 42, to vary the numbers and/or colors thereon.

Further, although the present invention has been discussed relative to a summation of numbers from the different elements, the present invention can also be used with other arithmetic operations, such as, subtraction, multiplication and/or division of the numbers from the different elements. For example, one die 28 and one card 50 can be used in a game, with the numbers being multiplied to form a resultant number used for wagering. In such case, however, the resultant numbers will vary from "2" through "60". Other combinations of elements can be used for the subtraction, multiplication and division. Thus, reference to "number combinations" herein includes number combinations resulting from arithmetic operations of summation, subtraction, multiplication and division.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

What is claimed is:

1. A gambling game comprising:

a dice table having an upper throwing surface on which dice can be thrown;

at least one die to be thrown on said upper throwing surface by a player, each die having a plurality of faces, each face having a number thereon, with the numbers of at least some of the faces being different from the numbers of other ones of the faces;

a rotatable wheel to be rotated by a dealer and positioned adjacent the dice table, the rotatable wheel having a plurality of segmented areas with different numbers thereon;

an indicator associated with the rotatable wheel for indicating one of said segmented areas of said rotatable wheel;

a plurality of cards, each card having a number thereon; and a wagering area including boxed areas for wagering on a single number resulting from an arithmetic operation which combines all of the following:

a) at least one number on an upper face of said at least one die, b) a number in an indicated segmented area of said rotatable wheel, and c) at least one number on at least one of said cards.

2. A gambling game according to claim 1, wherein there are two said dice.

3. A gambling game according to claim 1, wherein each said die includes six faces, at least some of said faces with a respective number thereon.

4. A gambling game according to claim 1, wherein at least one face on one said die includes an all lose area in which a player loses all wagers, regardless of the single number that results.

5. A gambling game according to claim 1, wherein at least one segmented area on said rotatable wheel includes an all lose area in which a player loses all wagers, regardless of the single number that results.

6. A gambling game according to claim 1, wherein said wagering area includes boxed areas for wagering on:

a) individual numbers based on combinations from an arithmetic operation of at least one number from an upper face of said at least one die, a number in an indicated segmented area and at least one number on at least one of said cards;

b) groups of numbers based on combinations from an arithmetic operation of at least one number from an upper face of said at least one die, a number in an indicated segmented area and at least one number on at least one of said cards.

7. A gambling game according to claim 1, wherein:

each said die includes a color thereon, with the colors of at least some of the faces being different from the colors of other ones of the faces;

said segmented areas includes different colors thereon; and said wagering area includes boxed areas for wagering on color combinations from a combination of at least one color on an upper face of said at least one die and a color in an indicated segmented area.

8. A gambling game according to claim 7, wherein said cards each include a color thereon, and said wagering area includes boxed areas for wagering on color combinations from a combination of at least one color on an upper face of said at least one die, a color in an indicated segmented area, and at least one color on at least one of said cards.

9. A gambling game according to claim 8, wherein said boxed areas for wagering on colors include boxed areas for wagering on:

a) all the same color based on color combinations from a combination of at least one color on an upper face of said at least one die, a color in an indicated segmented area, and at least one color on at least one of said cards; and b) different colors based on color combinations from a combination of at least one color on an upper face of said at least one die, a color in an indicated segmented area, and at least one color on at least one of said cards.

10. A gambling game comprising:

a dice table having an upper throwing surface on which dice can be thrown;

at least one die to be thrown on said upper throwing surface by a player, each die having a plurality of faces, each face having a number thereon, with the numbers of at least some of the faces being different from the numbers of other ones of the faces;

a plurality of cards, each card having a number thereon; and a wagering area including boxed areas for wagering on a single number resulting from an arithmetic operation which combines both of the following:

a) at least one number on an upper face of said at least one die, and b) at least one number on at least one of said cards.

11. A gambling game according to claim 10, wherein there are two said dice.

12. A gambling game according to claim 10, wherein each said die includes six faces, at least some of said faces with a respective number thereon.

13. A gambling game according to claim 10, wherein at least one face on one said die includes an all lose area in which a player loses all wagers, regardless of the single number that results.

14. A gambling game according to claim 10, wherein said wagering area includes boxed areas for wagering on:

a) individual numbers based on combinations from an arithmetic operation of at least one number from an upper face of said at least one die and at least one number on at least one of said cards;

b) groups of numbers based on combinations from an arithmetic operation of at least one number from an upper face of said at least one die and at least one number on at least one of said cards.

15. A gambling game according to claim 10, wherein:

each said die includes a color thereon, with the colors of at least some of the faces being different from the colors of other ones of the faces;

said cards each include a color thereon; and said wagering area includes boxed areas for wagering on color combinations from a combination of at least one color on an upper face of said at least one die and at least one color on at least one of said cards.

16. A gambling game according to claim 15, wherein said boxed areas for wagering on colors include boxed areas for wagering on:

a) all the same color based on color combinations from a combination of at least one color on an upper face of said at least one die and at least one color on at least one of said cards;

b) different colors based on color combinations from a combination of at least one color on an upper face of said at least one die and at least one color on at least one of said cards.

17. A gambling game comprising:

a rotatable wheel to be rotated by a dealer and positioned adjacent the dice table, the rotatable wheel having a plurality of segmented areas with different numbers thereon;

an indicator associated with the rotatable wheel for indicating one of said segmented areas of said rotatable wheel;

a plurality of cards, each card having a number thereon; and a wagering area including boxed areas for wagering on a single number resulting from an arithmetic operation which combines all of the following:

a) a number in an indicated segmented area of said rotatable wheel, and b) at least one number on at least one of said cards.

18. A gambling game according to claim 17, wherein at least one segmented area on said rotatable wheel includes an all lose area in which a player loses all wagers, regardless of the single number that results.

19. A gambling game according to claim 17, wherein said wagering area includes boxed areas for wagering on:

a) individual numbers based on combinations from an arithmetic operation of a number in an indicated segmented area and at least one number on at least one of said cards;

b) groups of numbers based on combinations from an arithmetic operation of a number in an indicated segmented area and at least one number on at least one of said cards.

20. A gambling game according to claim 17, wherein:

said segmented areas includes different colors thereon;

said cards each include a color thereon; and said wagering area includes boxed areas for wagering on color combinations from a combination of a color in an indicated segmented area and at least one color on at least one of said cards.

21. A gambling game according to claim 20, wherein said boxed areas for wagering on colors include boxed areas for wagering on:

a) all the same color based on color combinations from a combination of a color in an indicated segmented area and at least one color on at least one of said cards;

b) different colors based on color combinations from a combination of a color in an indicated segmented area and at least one color on at least one of said cards.

* * * * *

Disclaimer and Dedication

6,302,395 B1 — Morteza Astaneha, Hackensack, NJ. COMBINATION DICE, CARD AND ROULETTE GAMBLING GAME. Patent dated Oct. 16, 2005. Disclaimer and dedication filed Feb. 23, 2001, by the inventor.

Hereby disclaims and dedicates to the Public, the entire term of said patent.

*(Official Gazette May 17, 2005)*